US006626109B2

(12) United States Patent
Kündgen et al.

(10) Patent No.: US 6,626,109 B2
(45) Date of Patent: Sep. 30, 2003

(54) DEVICE FOR AUTOMATICALLY CHANGING PRINTING PLATES IN A PRINTING MACHINE

(75) Inventors: Rolf Kündgen, Eppelheim (DE); Burkhard Maass, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/163,008

(22) Filed: Jun. 5, 2002

(65) Prior Publication Data

US 2002/0178949 A1 Dec. 5, 2002

(30) Foreign Application Priority Data

Jun. 5, 2001 (DE) ..... 101 27 253

(51) Int. Cl.[7] ..... B41L 47/14; B41F 27/00

(52) U.S. Cl. ..... 101/477; 101/480; 271/276; 271/195

(58) Field of Search ..... 101/477, 415.1, 101/479, 480, 407.1; 271/276, 195; 198/493

(56) References Cited

U.S. PATENT DOCUMENTS

| | | | | |
|---|---|---|---|---|
| 3,633,902 A | * | 1/1972 | Worden | 271/264 |
| 5,183,251 A | * | 2/1993 | Sardella | 271/276 |
| 5,758,578 A | | 6/1998 | Metrope | |
| 6,112,663 A | * | 9/2000 | Ulrich et al. | 101/389.1 |

FOREIGN PATENT DOCUMENTS

| | | |
|---|---|---|
| DE | 44 04 558 C2 | 8/1995 |
| DE | 195 08 846 A1 | 9/1996 |
| DE | 196 17 744 A1 | 1/1997 |

* cited by examiner

*Primary Examiner*—Leslie J. Evanisko
(74) *Attorney, Agent, or Firm*—Laurence A. Greenberg; Werner H. Stemer; Gregory L. Myaback

(57) ABSTRACT

A device for automatically changing printing plates is provided in a printing machine having a plate cylinder to which a printing plate is to be fed and on which the printing plate is to be fixed detachably. The device includes a transport system for conveying the printing plate while permitting axial compensating movements thereof. The transport system has at least one driven transport roller and an air cushion for holding the conveyed printing plate in contact with the transport roller. The plate-holding air cushion is formed between a counterpressure element, on one side, and the printing plate, on the other side.

9 Claims, 1 Drawing Sheet

DEVICE FOR AUTOMATICALLY CHANGING PRINTING PLATES IN A PRINTING MACHINE

BACKGROUND OF THE INVENTION

Field of the Invention

The invention relates to a device for automatically changing printing plates in a printing machine.

When printing plates are being changed, on the one hand, it is imperative that a new printing plate be fed to the plate cylinder in register. On the other hand, it is likewise necessary to ensure that the printing plate be fed in without scratching.

For the purpose of register-maintaining alignment of the infed printing plate, the plate cylinder usually has register pins, which engage in assigned cut-outs formed on the leading edge of the printing plate. During this procedure, a given (slight) lateral compensating movement of the printing plate may occur. In order to avoid the risk entailed thereby of scratching the printing plate surface, the conveying drive must be conceived so that relative movements between the laterally moving printing plate and the transport rollers cooperating with the printing plate are avoided, if possible.

A device of the general type designated at the introduction hereto has become known heretofore from the published German Patent Document DE 44 04 558 C2. In the subject matter of this document, the lateral compensating movement of the printing plate without friction and therefore without scratches is made possible by the fact that driven transport rollers and corresponding counter-pressure or reaction rollers are mounted so as to be movable in the axial direction of the plate cylinder. This heretofore known construction necessitates a quite considerable expenditure for design and, therefore, is costly.

SUMMARY OF THE INVENTION

It is accordingly an object of the invention of the instant application to provide a device for automatically changing printing plates in a printing machine wherein an expenditure for achieving a scratch-free lateral compensating mobility of the printing plate is reduced.

With the foregoing and other objects in view, there is provided, in accordance with the invention, a device for automatically changing printing plates in a printing machine having a plate cylinder to which the printing plate is to be fed and on which the printing plate is to be fixed detachably, comprising a transport system for conveying the printing plate while permitting axial compensating movements thereof, the transport system having at least one driven transport roller and an air cushion for holding the conveyed printing plate in contact with the transport roller, the plate-holding air cushion being formed between the counterpressure element, on one side, and the printing plate, on the other side.

In accordance with another feature of the invention, compressed-air nozzles are formed as at least one of the counterpressure element and at least one constituent part of the counterpressure element, respectively, the nozzles being arranged spaced apart from one another, at least in a conveying direction of the printing plate, and being directed at least approximately perpendicularly to the printing plate guidable between the counterpressure element and the transport roller.

In accordance with a further feature of the invention, the compressed-air nozzles are of slit-like construction and have a slit length corresponding approximately to the width of the printing plate being conveyed.

In accordance with an added feature of the invention, the compressed-air nozzles are round nozzles, and are disposed spaced apart from one another both in the conveying direction of the printing plate and in a direction transverse thereto. In accordance with an additional feature of the invention, the printing plate is insertable in at least approximately vertical direction into the transport system, and wherein the air cushion serves for deflecting the printing plate, during transport thereof, in a direction towards the plate cylinder by utilizing flexibility of the printing plate in the process.

In accordance with yet another feature of the invention, the counterpressure element has a housing with a compressed-air supply, the compressed-air nozzles being arranged on a face of the housing of the counterpressure element facing towards the printing plate being conveyed.

In accordance with yet a further feature of the invention, the face of the housing of the counterpressure element facing towards the printing plate being conveyed has compressed-air nozzles formed therein and has a curvature at least approximately corresponding to the curvature of the printing plate being conveyed.

In accordance with yet an added feature of the invention, the housing of the counterpressure element, on a rear side of the housing, facing away from the printing plate being conveyed, is formed with a face at least approximately matching the face of said housing facing towards the printing plate being conveyed.

In accordance with a concomitant feature of the invention, the compressed-air nozzles are formed as throttle slits and bore holes, respectively.

An advantage of the invention when compared with the prior art outlined hereinabove is that only the driven transport roller or rollers have to be mounted laterally, i.e., in the axial direction of the plate cylinder, but not the air cushion which holds the printing plate in contact with the transport roller or rollers for automatically changing printing plates in a printing machine. This is because the air cushion according to the invention permits the printing plate to be pressed against the drive roller or rollers without contact and, therefore, without friction.

Other features which are considered as characteristic for the invention are set forth in the appended claims.

Although the invention is illustrated and described herein as embodied in a device for automatically changing printing plates in a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
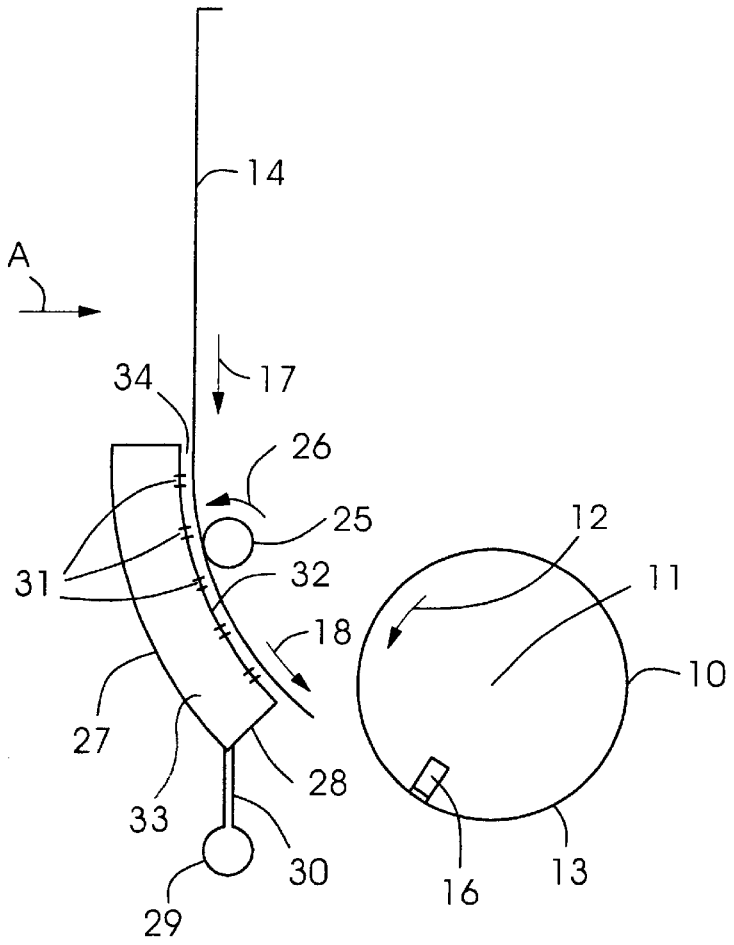
FIG. 1 is a diagrammatic and schematic side elevational view of an embodiment of a device for automatically changing printing plates, in accordance with the invention.

Referring now to the drawing and, first, particularly to FIG. 1 thereof, there is shown therein a plate cylinder 10 of a printing unit in a printing machine, for example, a sheet-fed offset printing machine. The plate cylinder 10 has an axis 11, about which the plate cylinder 10 is rotatable in a direction of rotation represented by a curved arrow 12. The plate cylinder 10 has, on the circumferential surface 13 thereof, conventional clamping and holding equipment for fixing a printing plate 14, the construction of such equipment being well known in the Art so that a detailed representation thereof has accordingly been omitted here.

Important constituent parts of the clamping and holding equipment are two register pins 15 and 16 which are spaced apart in the axial direction on the plate cylinder 10 (note FIG. 2) and which, as the printing plate 14 is infed in the direction of the arrows 17 and 18, respectively, ensure that the printing plate 14 is positioned in-register on the circumferential surface 13 of the plate cylinder 10. In this regard, the register pins 15 and 16 cooperate with respective cut-outs 19 and 20 (note FIG. 2) formed on the leading edge 21 of the printing plate 14, by engaging with an accurate fit in the respective cut-outs 19 and 20.

Figure 2:
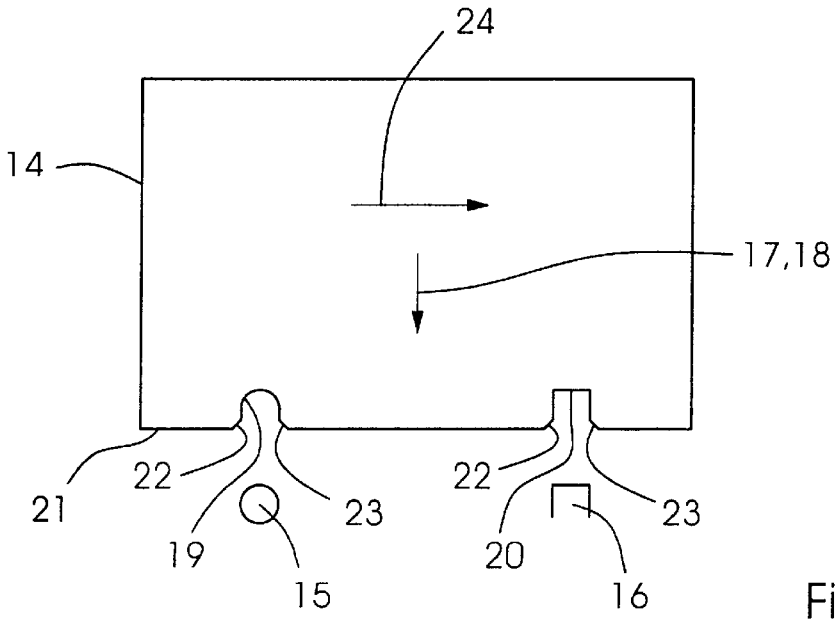
FIG. 2 is a fragmentary view of FIG. 1 as seen in the direction of the arrow A, and showing an embodiment of a printing plate in plan view.

The cut-outs 19 and 20, respectively, are provided with respective run-on bevels 22 and 23 on the sides thereof, which permit and effect, respectively, a lateral compensating movement of the printing plate 14 if, as the printing plate 14 is being infed in the direction of the respective arrows 17 and 18, no exact alignment between the respective cut-outs 19 and 20, on the one hand, and the register pins 15 and 16, on the other hand, is provided. Such a situation is indicated in FIG. 2. In this case, the run-on bevels 23 come into play and effect an appropriate lateral movement of the printing plate 14 in the direction of arrow 24, which corresponds to the axial direction of the plate cylinder 10 on which the printing plate 14 is being mounted.

A transport roller 25 provides for the required drive of the printing plate 14 while it is being fed to the plate cylinder 10, as is indicated diagrammatically in FIG. 1, the transport roller 25 being driven in a suitable manner which is not specifically illustrated, for example, by an electric motor. The direction of rotation of the transport roller 25, as the printing plate 14 is infed in the direction of the respective arrows 17 and 18, is represented by an arrow 26.

In order to accomplish the conveyance of the printing plate 14 by the transport roller 25 in the aforedescribed manner, the printing plate 14 must be held in contact with the transport roller 25, as is apparent from FIG. 1. This task is performed by a counterpressure or reaction element formed as a hollow body identified overall by reference numeral 27. The counterpressure element 27 has a housing 28, to which compressed air is fed via a pressure line 30 by a compressed-air supplier 29, for example, a pump. At the side adjacent the printing plate 14, the housing 28 of the counterpressure element 27 has a curved face 32 which is fitted with nozzle openings 31 and has a curvature corresponding to the curvature of the printing plate 14 in this region. In addition, a rear face 33 of the housing 28 of the counterpressure element 27 is formed correspondingly curved, so that the overall result is a curved counterpressure element 27 having an advantageous shape with respect to installation space.

As. FIG. 1 further reveals, the nozzle openings 31, which are preferably throttling slits or bores, are arranged spaced mutually apart in the longitudinal direction and in the conveying direction 17, 18, respectively, of the printing plate 14, so that the printing plate 14 has compressed air applied thereto not only immediately at the point of contact thereof with the transport roller 25 but also above and below the latter, if possible over the entire width thereof. If the nozzle openings 31 are throttle bores, i.e., round nozzles, a plurality of rows of the throttle bores 31 mutually spaced apart transversely with respect to the conveying direction 17, 18 should accordingly be provided.

The special feature of the transport device which is apparent from FIG. 1 and is described hereinabove is that, by providing the compressed air flowing out of the nozzle openings 31 and striking the printing plate 14, an air cushion is built up in the (curved) gap 34 between the counterpressure element 27, on the one side, and the printing plate 14, on the other side. The printing plate 14 is pressed by the air cushion against the driven and driving, respectively, transport roller 25, without any direct contact taking place between the counterpressure element 27 and the printing plate 14. By this there is advantageously meant that any friction between the counterpressure element 27 and the printing plate 14 is avoided, for example, if the printing plate 14, for the purpose of maintaining in-register alignment on the plate cylinder 10 (in this regard, note the foregoing explanations), has to perform a given lateral movement, for example, in the direction of the arrow 24 in FIG. 2.

In order also to avoid friction between the transport roller 25 and the printing plate 14, if possible, the transport roller 25, as conventionally known of itself, should be mounted so that it is movable in the axial direction of the plate cylinder 10. It is also believed to be quite clear that the transport roller 25 has to be arranged at the rear side of the printing plate 14 to be conveyed, i.e., the side of the printing plate 14 facing away from the counterpressure element 27, because, otherwise, due to a lack of opposing holding force, no air cushion could be built up in the curved gap 34.

The hereinaforedescribed device seen in the drawing, in particular in FIG. 1, also fulfills, in a corresponding manner, the function of transporting a (used) printing plate away from the plate cylinder 10. For such a case, the drive direction of the transport roller 25 must be reversed, however.

We claim:

1. In a printing machine having a plate cylinder and printing plates to be fed to and detachably fixed on the plate cylinder, a device for automatically changing the printing plates, comprising:

a transport system for conveying a printing plate while permitting axial compensating movements of the printing plate, said transport system having at least one driven transport roller, a counterpressure-element and an air cushion for holding the conveyed printing plate in contact with said transport roller, said plate-holding air cushion formed between said counterpressure element and the printing plate.

2. The changing device according to claim 1, which further comprises compressed-air nozzles forming at least part of said counterpressure element, said nozzles spaced apart from one another, at least in a conveying direction of the printing plate, and directed at least approximately perpendicularly to the printing plate guided between said counterpressure element and said transport roller.

3. The changing device according to claim 2, wherein said compressed-air nozzles have a slit shape and a slit length corresponding approximately to a width of the printing plate being conveyed.

4. The changing device according to claim 2, wherein said compressed-air nozzles are round nozzles and are spaced apart from one another both in the conveying direction of the printing plate and in a direction transverse to the conveying direction.

5. The changing device according to claim 2, wherein said counterpressure element has a housing with a compressed-air supply and a face facing towards the printing plate being conveyed, and said compressed-air nozzles are disposed on said face of said housing.

6. The changing device according to claim 5, wherein said face of said housing of said counterpressure element facing towards the printing plate being conveyed has said compressed-air nozzles formed therein and has a curvature at least approximately corresponding to a curvature of the printing plate being conveyed.

7. The changing device according to claim 6, wherein said face of said housing facing towards the printing plate being conveyed has a given contour, said housing of said counterpressure element has a rear side facing away from the printing plate being conveyed, and said rear side is formed with a face at least approximately matching said given contour.

8. The changing device according to claim 2, wherein said compressed-air nozzles are formed as throttle slits and bore holes.

9. The changing device according to claim 1, wherein said transport system receives the printing plate at least approximately vertically, and said air cushion deflects the printing plate during transport thereof, in direction of the plate cylinder by utilizing flexibility of the printing plate.

* * * * *